US007210395B2

(12) United States Patent
Strandberg et al.

(10) Patent No.: US 7,210,395 B2
(45) Date of Patent: May 1, 2007

(54) SYSTEM FOR HANDLING A TOOL AT A VEHICLE

(75) Inventors: Lennart Strandberg, Falun (SE); Bo Vigholm, Stora Sundby (SE); Johan Lillemets, Eskilstuna (SE)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 0 days.

(21) Appl. No.: 10/908,141

(22) Filed: Apr. 28, 2005

(65) Prior Publication Data

US 2005/0198951 A1 Sep. 15, 2005

Related U.S. Application Data

(63) Continuation of application No. PCT/SE03/01808, filed on Nov. 19, 2003.

(30) Foreign Application Priority Data

Nov. 19, 2002 (SE) ..... 0203414

(51) Int. Cl.
*F15B 11/024* (2006.01)

(52) U.S. Cl. ..... 91/437

(58) Field of Classification Search ..... 91/437
See application file for complete search history.

(56) References Cited

U.S. PATENT DOCUMENTS 3,630,121 A * 12/1971 Landaeus et al. ..... 91/437
4,024,796 A * 5/1977 Theobald ..... 91/437
5,293,944 A 3/1994 Matsumoto
5,351,601 A * 10/1994 Zeuner et al. ..... 91/445
5,353,686 A 10/1994 Nakamura
5,622,226 A 4/1997 Hausman et al.

FOREIGN PATENT DOCUMENTS

EP 0608096 7/1994

* cited by examiner

*Primary Examiner*—F. Daniel Lopez
(74) *Attorney, Agent, or Firm*—WRB-IP LLP

(57) ABSTRACT

The invention relates to a system for handling an implement on a vehicle which comprises a frame. The system comprises a lifting apparatus arranged between the frame and the implement for raising and lowering the implement in relation to the frame, a pump (11) coupled to the lifting apparatus for supplying this with a fluid in order to produce said movements, and an operating valve (10) arranged between the pump and the lifting apparatus for controlling the flow of said fluid to the of said fluid to and from the lifting apparatus. The system further comprises a control device (9) which is designed to disconnect the control of the lifting apparatus via said fluid. The control device is coupled in such a way to an operating element 814) arranged in the vehicle cab (13) that control of the control device via the operating element is permitted independently of the control of the operating valve.

24 Claims, 7 Drawing Sheets

SYSTEM FOR HANDLING A TOOL AT A VEHICLE

This application is a continuation of International Application No. PCT/SE2003/001808, filed Nov. 19, 2003, which claims priority to Swedish Application No. 0203414-8, filed Nov. 19, 2002, both of which are incorporated by reference.

FIELD OF THE INVENTION

The present invention relates to a system for handling an implement on a vehicle which comprises a frame, the system comprising a lifting apparatus arranged between the frame and the implement for raising and lowering the implement in relation to the frame, 'a pump coupled to the lifting apparatus for supplying this with a fluid in order to produce said movements, and an operating valve arranged between the pump and the lifting apparatus for delivering said fluid to the lifting apparatus and evacuating it therefrom.

The invention will be described below in connection with a machine in the form of a wheeled loader. This is a preferred, but in no way restrictive application of the invention.

A wheeled loader is equipped with a lifting apparatus in the form of a load arm assembly for raising/lowering the implement. The load arm assembly in turn comprises a number of hydraulic cylinders for undertaking said movement of the implement. The implement may consist for example of a load shovel or excavator blade.

In certain operating situations there is a need to disconnect the hydraulic control of the lifting apparatus in order to allow the implement to follow the ground with a force corresponding to its own weight and accordingly to remain unaffected by the vehicle hydraulic system. This will hereinafter be referred to as the free-floating function.

DESCRIPTION OF THE PRIOR ART

According to a known solution for obtaining the free-floating function, this function is achieved by means of the operating valve. The free-floating function may be said to be integrated into the operating valve. A number of servo valves are coupled to the operating valve which, in response to a signal that free-floating is required, control the operating valve in such a way that connections of the hydraulic cylinders are coupled to a tank via the operating valve. However, this is associated with certain problems; it has a negative effect on the maximum slide deflection for lowering of the implement and the free-floating function may interfere with other functional characteristics of the operating valve.

SUMMARY OF THE INVENTION

An object of the invention is to provide a system for handling an implement which will lead to increased operating reliability.

This object is achieved in that the system comprises a control device which is designed to disconnect the control of the lifting apparatus via said fluid, and in that the control device is coupled in such a way to an operating element arranged in the vehicle of cab that control by the control device via the operating element is permitted independently of the control of the operating valve.

The operating valve is therefore disengaged from controlling the lifting apparatus when free-floating is required and free-floating is instead achieved via said control device.

By disconnecting the control via said fluid, the lifting apparatus can instead be disconnected in such a way that the only force acting on the implement is its own weight.

According to a preferred embodiment the control device is coupled to ports of the lifting apparatus for the supply and evacuation of said fluid in order to connect the ports to atmospheric pressure in the event of disconnection. The control device preferably ensures that all ports of the lifting apparatus are connected to atmospheric pressure. The ports are suitably coupled to a tank.

According to another preferred embodiment the control device comprises a first control valve. The first control valve is connected between the operating valve and the lifting apparatus in the circuit for said fluid in order to achieve said disengagement of the operating valve.

According to a development of the preceding embodiment the control device comprises a second control valve. The second control valve is connected between the operating element and the operating valve and connected to the first control valve.

BRIEF DESCRIPTION OF THE DRAWINGS

The invention will be described in more detail below with reference to the embodiments shown in the drawings attached, in which.

DETAILED DESCRIPTION OF PREFERRED EMBODIMENTS

Figure 1:
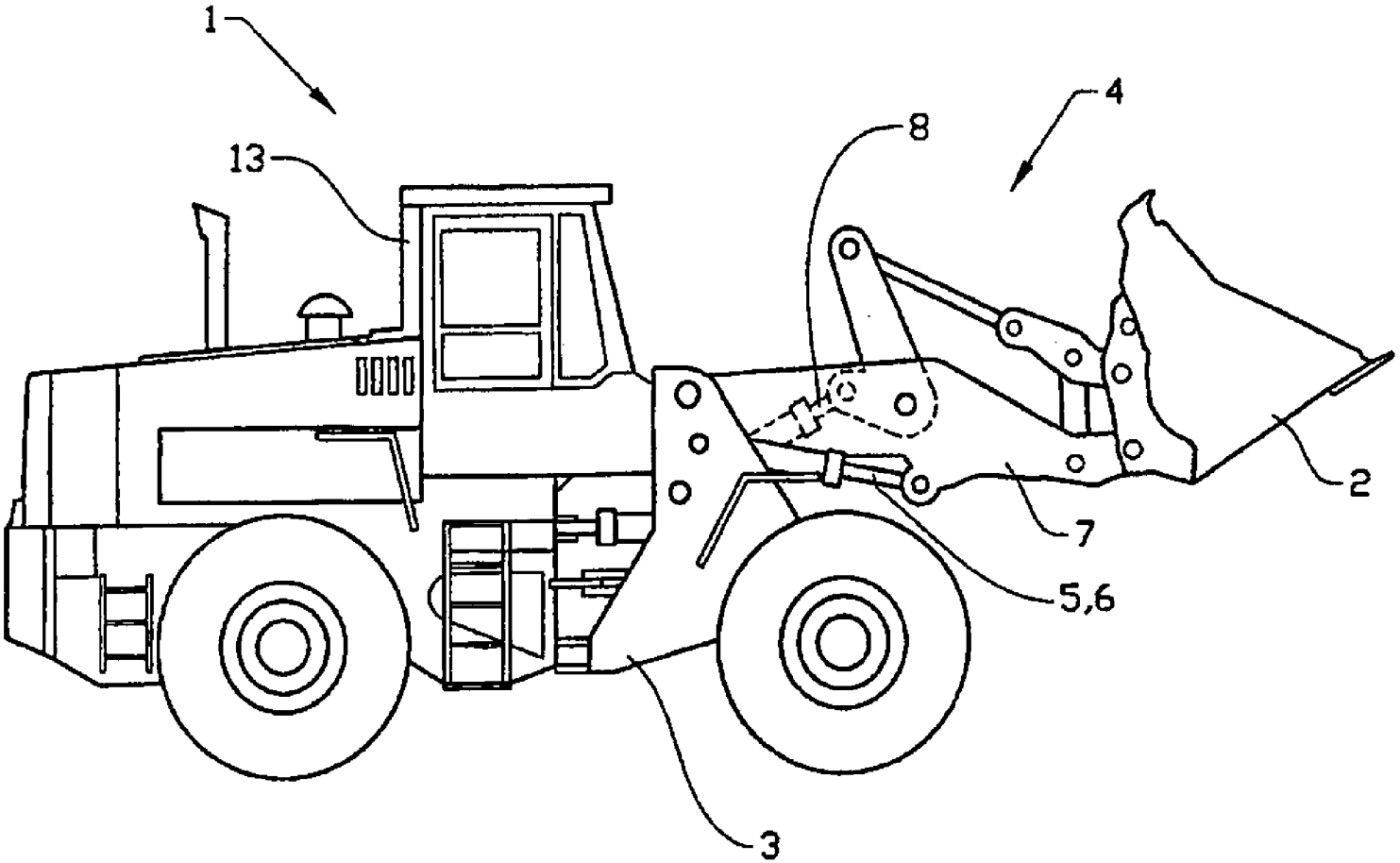
FIG. 1 shows a side view of a wheeled loader.

FIG. 1 shows a side view of a wheeled loader 1. The wheeled loader 1 has an implement 2 in the form of a shovel, which can be raised and lowered in relation to the vehicle frame 3, and more specifically the front part thereof, via a lifting apparatus 4. The lifting apparatus 4 here consists of a load arm assembly and comprises two hydraulic cylinders 5,6, each of which is connected at one end to the front vehicle part 3 and at its other end to a beam 7 on the load arm assembly.

The shovel 2 can furthermore be tilted in relation to the load arm assembly via a third hydraulic cylinder 8, which is connected by one end to the front vehicle part 3 and by its other end to the shovel 2 via a linkage system.

Various embodiments of a system for the handling of an implement of the wheeled loader 1 are described below with reference to FIGS. 2 to 7. The description relates more specifically to a system which allows the hydraulic control of the lifting apparatus to be disconnected in order to allow the implement to follow the ground with a force corresponding to its own weight and accordingly to remain unaffected by the vehicle hydraulic system. This will be referred to below as the free-floating function.

Figure 2:
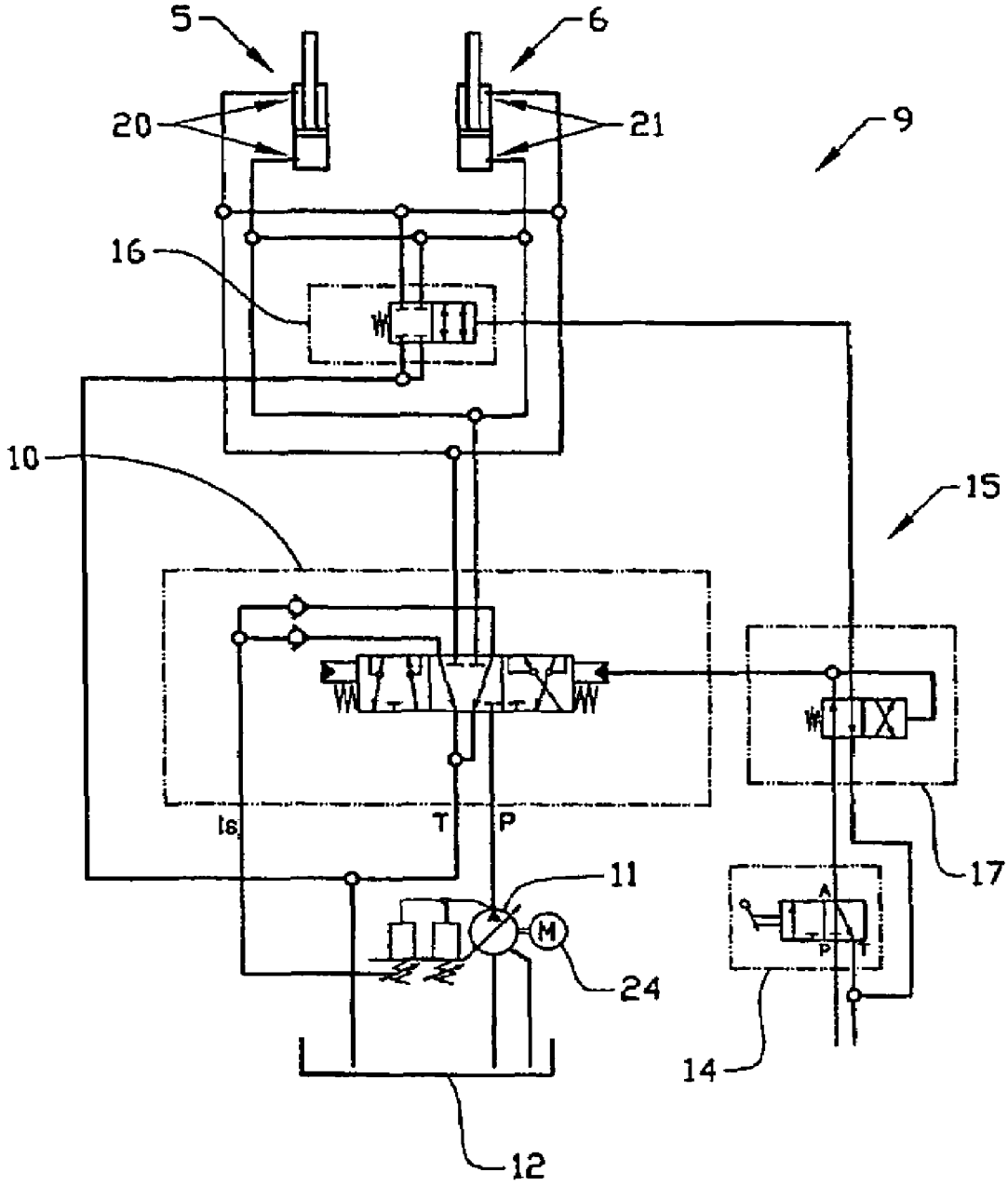
FIGS. 2–7 show a first, second, third, fourth, fifth and sixth embodiment of the system.

FIG. 2 illustrates a system 9 for handling of the implement. The system 9 comprises an operating valve 10, which is hydraulically connected to the hydraulic cylinders 5,6 and to a pump 11 and tank 12 for supplying the hydraulic cylinders with a hydraulic fluid via a hydraulic circuit. According to this embodiment the operating valve 10 comprises only one slide.

The vehicle engine 24 drives said pump 11 for supplying the hydraulic system. The hydraulic system is of load-sensing type, which means that the pump 11 only delivers oil when and where it is required. The pump 11 senses the pressure from the hydraulic cylinders and subsequently adjusts to a pressure which is a specific number of bar higher than the pressure in the cylinders.

The system 9 further comprises an operating element 14 arranged in the cab 13 of the wheeled loader 1 and intended for manual operation by the driver. The operating element 14 consists of a control, such as a lever or a button in the cab. The system 9 further comprises a control device 15 which is designed to disconnect the control of the lifting apparatus, and more specifically the hydraulic cylinders 5,6, by way of said fluid. The control device 15 is coupled to the operating element 14 in such a way that control by the control device via the operating element 14 is permitted independently of the control of the operating valve 10. The hydraulic cylinders 5,6 are accordingly disconnected from control via the operating valve 10 and are controlled via the control device 15.

The control device 15 comprises a first control valve 16 which is operatively connected in parallel with the operating valve 10. The first control valve 16 is more specifically connected between the operating valve 10 and the hydraulic cylinders 5,6 in the circuit for said fluid. In order to achieve the free-floating function the hydraulic cylinders 5,6 are disconnected from control by the operating valve 10 and are controlled by the first control valve 16. The control device 15 further comprises a second control valve 17 which is operatively connected between the operating element 14 and the operating valve 10. The second control valve 17 is moreover operatively connected to the first control valve 16 for controlling the latter. The first and second control valves 16,17 are hydraulically controlled. The first and second control valves 16,17 each comprise only one slide.

The method of achieving the free-floating function is as follows: Operation of the operating element 14 delivers a pressure of 0–18 bar, for example, to the operating valve 10 via the second control valve 17 for normal lowering movement of the hydraulic cylinders 5,6. This is usually termed "powerdown". At a first set pressure value of 18 bar, for example, the lever attains a threshold position, in the form of a power index usually termed "prefeeling". When the operating element 14 is shifted through this position and beyond, the pressure increases and at a second set pressure value, for example 20 bar, the second control valve 17 shifts, which means that the control pressure for the slide of the operating valve 10 is relieved and the slide moves to the neutral position. At the same time a pressure is built up in order to control the first control valve 16 and at a third set pressure value, for example 25 bar, the valve 16 shifts, the hydraulic cylinders 5,6 are connected to a tank, and the free-floating function is achieved.

Figure 3:
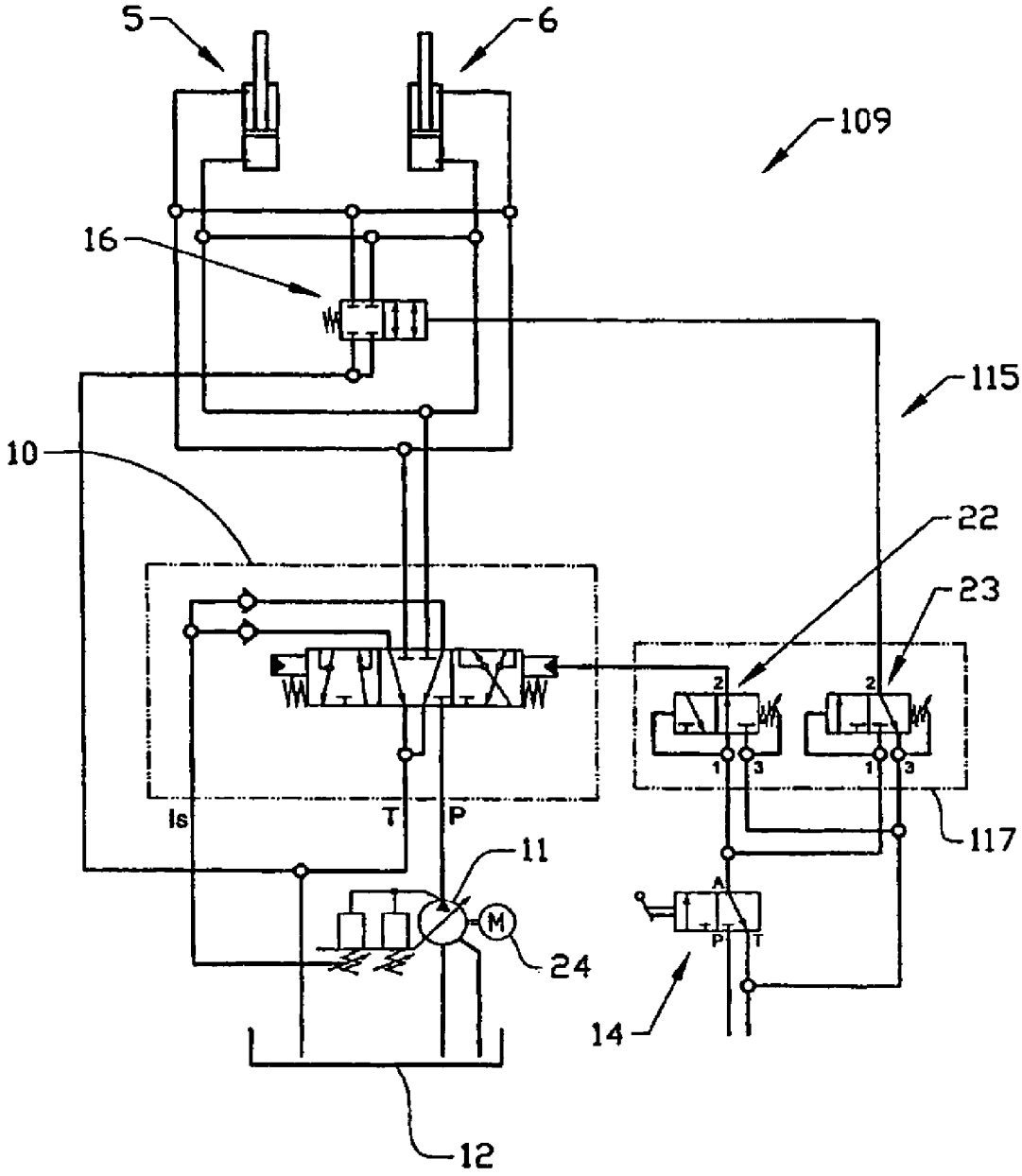

FIG. 3 illustrates a second preferred embodiment of the system 109. This is a variant of the first embodiment.

The difference is that the second control valve 117 of the control device 115 comprises two slides 22,23.

Operating the operating element 14 delivers a pressure of 0–18 bar, for example, to the operating valve 10 via the first slide 22. At a first preset pressure, for example 18 bar, the first control valve 22 closes, thereby shutting off the supply of fluid to the operating valve 10. At a third preset pressure value, for example 25 bar, the second valve 23 is opened, which means that a pressure is delivered to the first control valve 116 via the second slide 23. The first control valve 116 is thereby opened for normal lowering movement of the hydraulic cylinders 5,6.

Figure 4:
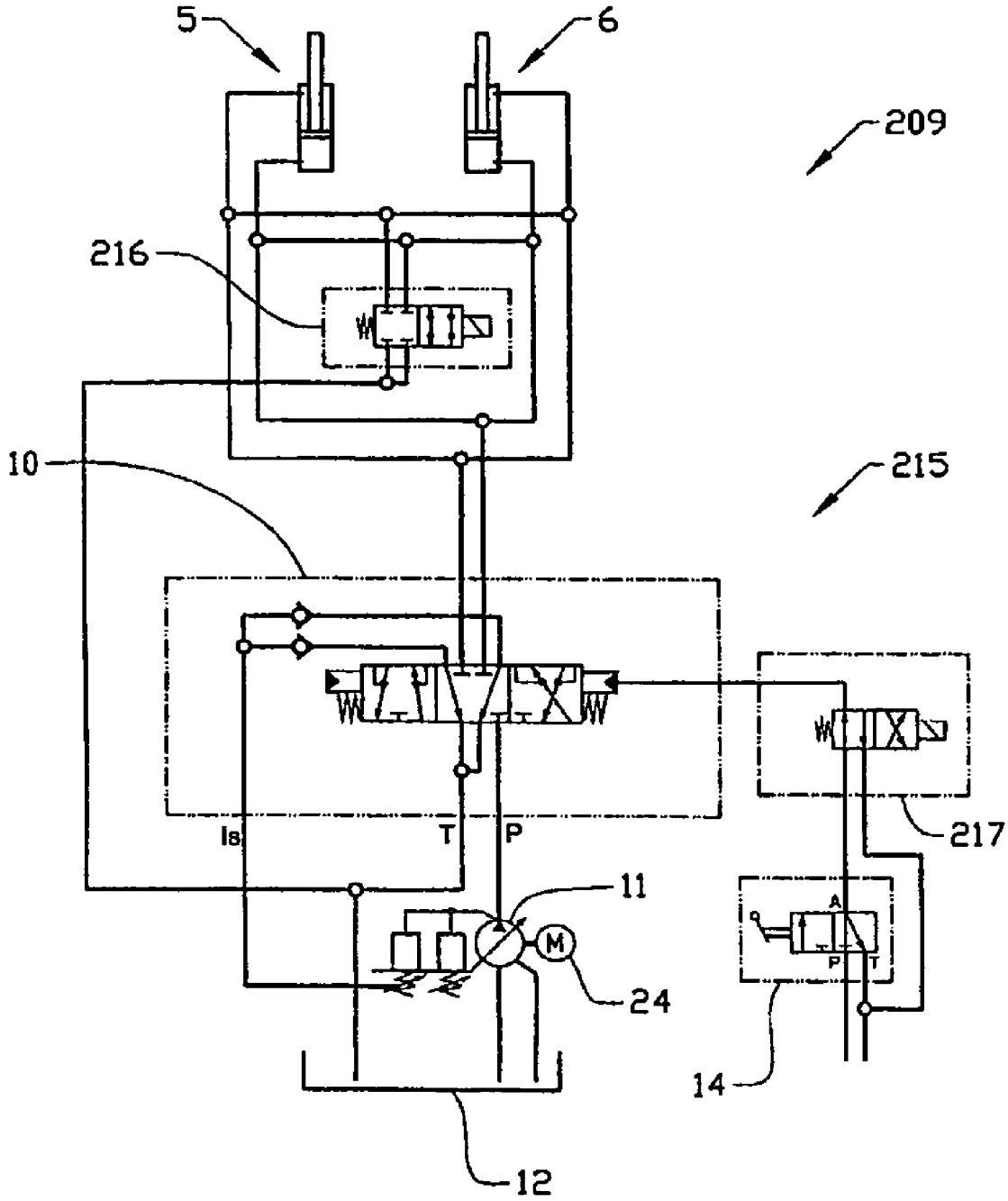

FIG. 4 illustrates a system 209 for handling the implement. According to this embodiment the first and second control valves 216,217 of the control device 215 are electrically controlled. This means that the free-floating function can be engaged without first passing through the "powerdown" position. As a result there is no need to expose the underlying surface or the implement being used to large forces before the free-floating function is engaged.

Figure 5:
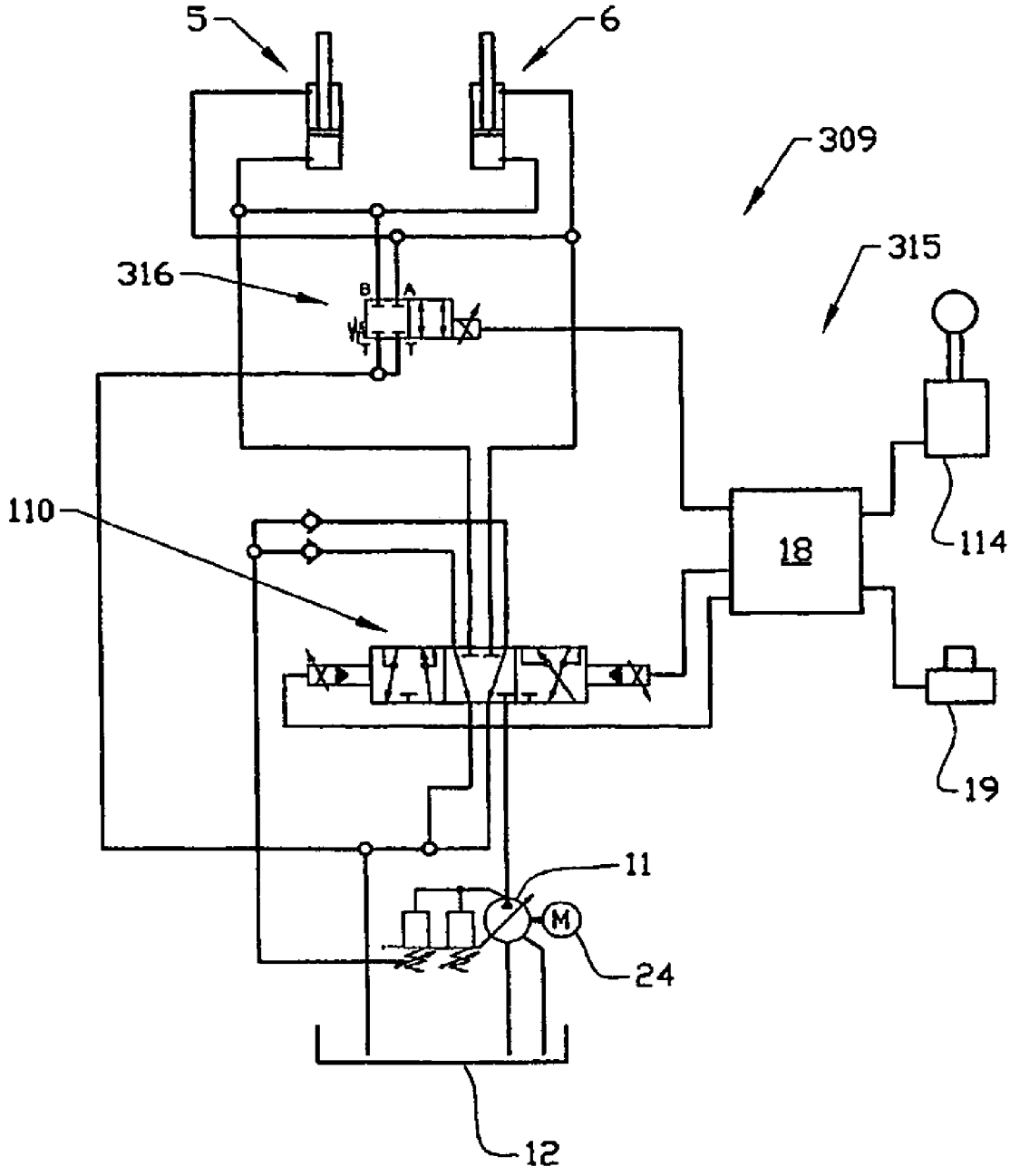

FIG. 5 illustrates a system 309 for handling the implement. According to this embodiment the first control valve 316 of the control device 315 and the operating valve 110 are electrically controlled.

Furthermore, a control unit 18, or computer, is electrically connected to the operating element 114. The control unit 18 is also electrically connected to the first control valve 216 and the operating valve 110 for controlling these.

An activating element 19, suitably in the form of a button or other control, is coupled to the control unit 18 and arranged in the cab 13 for operation by the driver of the vehicle. The activating element 19 enables the driver to choose whether the free-floating function or ordinary lowering function is required. If the activating element 19 is in the off position the lowering function is operated via the operating element 114. In this position the free-floating function cannot be engaged. If the activating element 19 is in the on position the free-floating function can be activated proportionally via the operating element 1114. In this position the lowering function is deactivated. In the extreme position of the operating element, which in the figure consists of a lowering lever, it can also be locked by means of a hold function.

The first valve 216 may be either of the on-off type or proportional to the lever deflection.

The same control, the operating element 1114, is therefore used for operation both of the lowering function and of the free-floating function.

Figure 6:
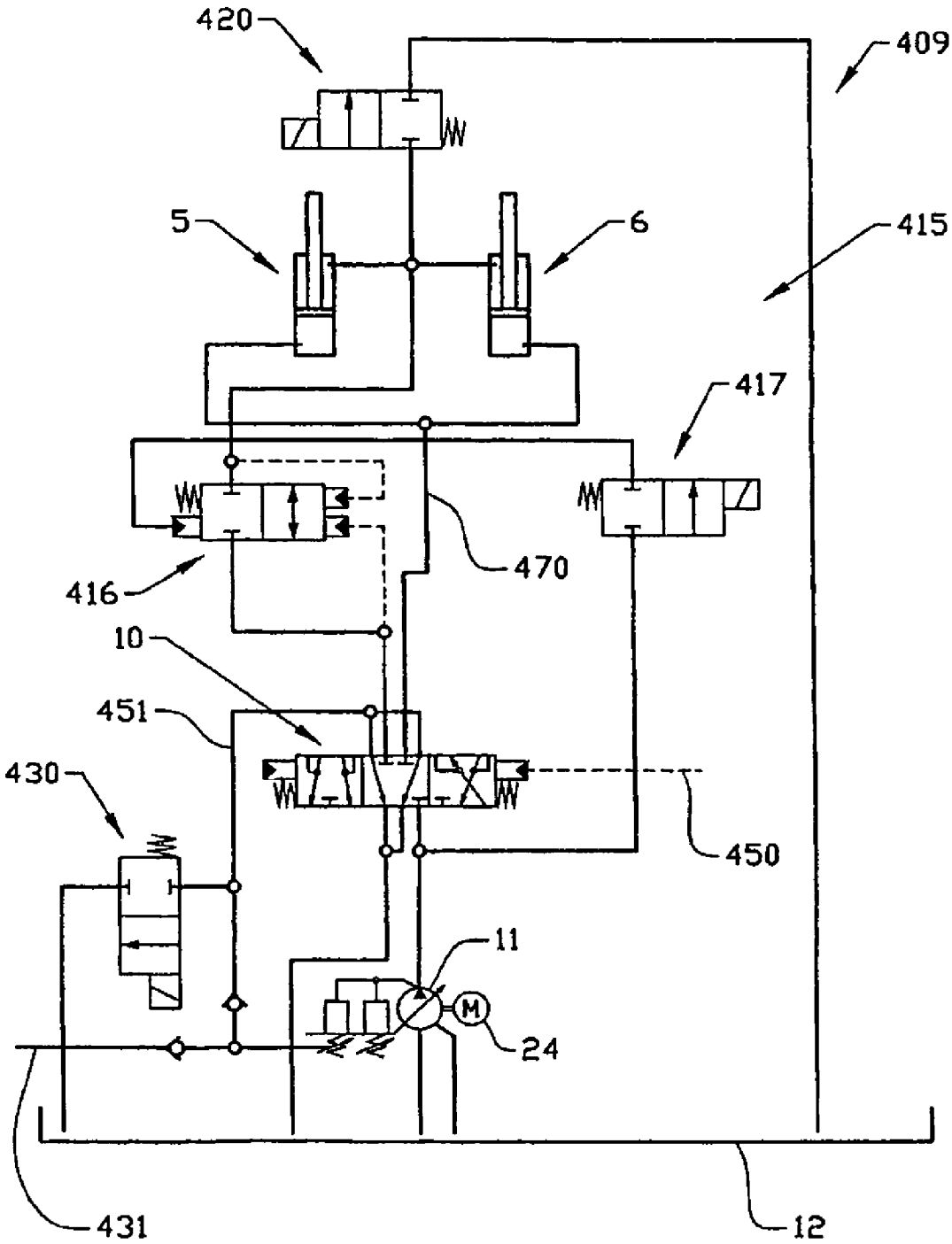

FIG. 6 illustrates a system 409 for handling the implement. The normal lowering movement (that is to say not the free-floating function) is achieved by means of an electrical input signal 450 to the operating valve (main valve) 10. The slide of the main valve 10 is then moved one step to the left in the drawing. The pump 11 then delivers a pressure to the first control valve (load-maintaining valve) 416. In this embodiment the load-maintaining valve 416 is connected in series downstream of the main valve 10, that is to say between the main valve 10 and the hydraulic cylinders 5,6. The load-maintaining valve 416 will then be opened, that is to say the slide is shifted to the left in the drawing, via a system of sequence valves (not shown). The sequence valves are more specifically designed so that the left-hand side of the load-maintaining valve 416 is drained to the tank. The pump pressure is then delivered to the piston rod sides of the hydraulic cylinders 5,6.

The piston sides of the hydraulic cylinders 5,6 are connected the tank 12 via the main valve 10 in a line 470 in parallel with load-maintaining valve 416.

In order to achieve the free-floating function, the second control valve 417 is opened by means of an electrical signal. The second control valve 417 is directly coupled to the load-maintaining valve 416 for controlling the latter. The load-maintaining valve 416 is then closed by the pump pressure via the second control valve 417 (the slide of the load-maintaining valve is moved back to the right in the drawing). The opening for the pump flow to the hydraulic cylinders 5,6 will then be closed. Closing of the load-maintaining valve 416 means that the pump flow can be used for other functions/components in the hydraulic system. The system 409 comprises an electrically controlled third control valve 420 coupled to the piston sides of the hydraulic cylinders 5,6 and to the tank 12. The third control valve 420 is more specifically coupled between the piston sides of the hydraulic cylinders 5,6 and the tank 12. The third control valve 420 is opened by means of an electrical signal, and the piston rod sides of the hydraulic cylinders 5,6 are thereby connected to the tank 12 and the free-floating function is achieved.

An arrangement of non-return valves and a fourth control valve 430 is located on a line 431 for a load-sensing signal from another function/component to the pump. This arrangement ensures that if another function/component is used, it is this load pressure that controls the pump.

The first, second and third control valves 416,417, 420 may alternatively be hydraulically controlled.

Figure 7:
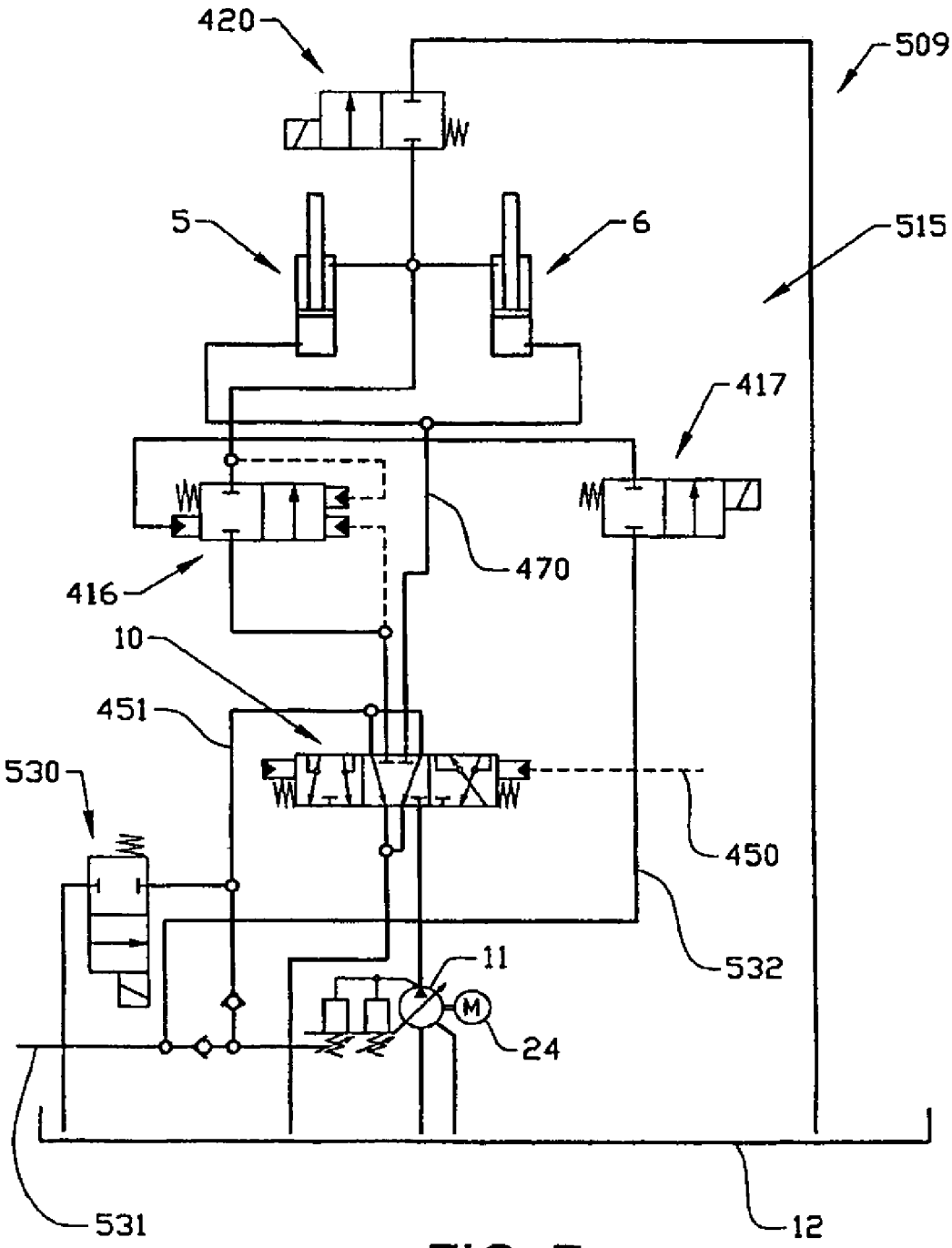

FIG. 7 illustrates a system 509 for handling the implement. This sixth embodiment differs from the fifth embodiment in FIG. 6 in that here the load-maintaining valve 416 is closed by means of a load-sensing signal 531 from another function/component. In other words the load-maintaining valve 416 is closed when the pump 11 delivers pump pressure to another function/component. In this case the pump 11 is left to pump to the tank through the main valve 10 and the load-maintaining valve 416 when no other function/component in the hydraulic circuit is in use. The second control valve 417 is accordingly arranged on a line 532 which delivers a load-sensing pressure from said second function/component for opening/closing this. According to the fifth embodiment the load-maintaining valve 3 is instead closed by means of the pump pressure. The system according to the sixth embodiment comprises a somewhat different arrangement 530 of non-return valves and the fourth control valve in order to deliver the load-sensing signal partly to the line 532 to the second control valve 417 on the one hand and to the pump 11 on the other.

In the fifth and sixth embodiments, se FIGS. 6 and 7, the activation of the free-floating function via the operating element has not been shown. This can be done in any of the ways described in the previous embodiments.

The control device 15,115, 215,315, 415,515 is accordingly designed to be controlled independently of the operating valve 10,110, and thereby designed to be capable of functioning separately from the operating valve. The control device is designed to disconnect the control of the lifting apparatus via said fluid with the aim of providing a free-floating function for the implement.

However, the control device need not necessarily be controlled entirely without actuation of the operating valve 10,110. The concept of controlling the control device independently of the operating valve therefore also includes the facility for controlling the operating valve by means of the operating element. The control device is nevertheless designed to be controlled independently, which means that it is shifted/activated independently of what is actually done with the operating valve.

The invention must not be regarded as being limited to the examples of embodiment described above, a number of further variants and modifications being feasible within the scope of the following claims.

What is claimed is:

1. A system for handling an implement on a frame, the system comprising a lifting apparatus adapted to be arranged between a frame and an implement for raising and lowering the implement in relation to the frame, a pump for supplying the lifting apparatus with a fluid in order to raise and lower the implement, an operating valve arranged between the pump and the lifting apparatus for controlling flow of the fluid to and from the lifting apparatus to control the lifting apparatus, a control device adapted to disconnect control of the lifting apparatus via the operating valve, an operating element coupled to the control device such that control of the control device via the operating element is permitted independently of control of the operating valve, and the control device comprising a control element between the operating element and the operating valve, the control element being adapted to control the operating valve, wherein the operating element is adapted to control the control element to control the operating valve.

2. The system as claimed in claim 1, wherein the control device is coupled to ports of the lifting apparatus for supply and evacuation of the fluid in order to connect the ports to atmospheric pressure in the event of disconnection.

3. The system as claimed in claim 1, wherein the control device comprises a first control valve coupled to ports of the lifting apparatus for supply and evacuation of the fluid in order to connect the ports to atmospheric pressure in the event of disconnection.

4. The system as claimed in claim 3, wherein the first control valve is in a line that is connected between the operating valve and the lifting apparatus in the circuit for the fluid.

5. The system as claimed in claim 3, wherein the control element comprises a control unit.

6. The system as claimed in claim 5, wherein the control element is connected to the first control valve.

7. The system as claimed in claim 3, wherein the control element comprises a second control valve.

8. The system as claimed in claim 7, wherein at least one of the first and the second control valve is hydraulically controlled.

9. The system as claimed in claim 7, wherein at least one of the first and the second control valve is electrically controlled.

10. The system as claimed in claim 9, wherein the operating valve is electrically controlled.

11. The system as claimed in claim 9, wherein the control device comprises a control unit for the electrical control.

12. The system as claimed in claim 11, wherein the control device comprises an activating element connected to the control unit, coupled so that on activation it allows control of the control device via the operating element and designed for operation by the driver of the vehicle.

13. The system as claimed in claim 1, wherein the operating element is connected to the operating valve for controlling the latter.

14. The system as claimed in claim 1, wherein the lifting apparatus comprises at least one hydraulic cylinder.

15. The system as claimed in claim 1, wherein the operating valve comprises one slide and the control device comprises two slides.

16. The system as claimed in claim 1, wherein the system handles a lifting element on a vehicle, and the operating element is arranged in a cab of the vehicle.

17. A system for handling an implement on a frame, the system comprising a lifting apparatus adapted to be arranged between a frame and an implement for raising and lowering the implement in relation to the frame, a pump for supplying the lifting apparatus with a fluid in order to raise and lower the implement, an operating valve arranged between the pump and the lifting apparatus for controlling flow of the fluid to and from the lifting apparatus to control the lifting apparatus, a control device adapted to disconnect control of the lifting apparatus via the operating valve, an operating element coupled to the control device such that control of the control device via the operating element is permitted independently of control of the operating valve, and the control device comprising a control element between the operating element and the operating valve, the control element being adapted to control the operating valve, wherein the control device comprises a first control valve coupled to ports of the lifting apparatus for supply and evacuation of the fluid in order to connect the ports to atmospheric pressure in the event of disconnection, wherein the control element comprises a second control valve, and wherein the second control valve comprises two slides.

18. Machine, comprising:

a frame;

an implement attached to the frame; and a system comprising a lifting apparatus arranged between the frame and the implement for raising and lowering the implement in relation to the frame, a pump for supplying the lifting apparatus with a fluid in order to raise and lower the implement, an operating valve arranged between the pump and the lifting apparatus for controlling flow of the fluid to and from the lifting apparatus to control the lifting apparatus, a control device adapted to disconnect control of the lifting apparatus via the operating valve, an operating element coupled to the control device such that control of the control device via the operating element is permitted independently of control of the operating valve, and the control device comprising a control element between the operating element and the operating valve, the control element being adapted to control the operating valve, wherein the operating element is adapted to control the control element to control the operating valve.

19. The system as claimed in claim 18, wherein the control device comprises a first control valve coupled to ports of the lifting apparatus for supply and evacuation of the fluid in order to connect the ports to atmospheric pressure in the event of disconnection.

20. The system as claimed in claim 19, wherein the first control valve is in a line that is connected to the operating valve and the lifting apparatus in the circuit for said fluid.

21. The system as claimed in claim 20, wherein the control element comprises a second control valve.

22. The machine as claimed in claim 18, wherein the machine is a vehicle, and the operating element is arranged in a cab of the vehicle.

23. A method for shifting a system for switching a lifting apparatus arranged between a frame and an implement for raising and lowering the implement in relation to the frame between a normal operating mode in which an operating valve controls fluid flow to and from the lifting apparatus to control the lifting apparatus to a float mode in which control of the lifting apparatus is independent of the operating valve, comprising:

supplying the lifting apparatus with a fluid via a pump in the normal operating mode, in order to raise and lower the implement, by shifting an operating valve arranged between the pump and the lifting apparatus between a neutral position and a lowering position for controlling the lifting apparatus via the operating valve, shifting the system to a float mode by disconnecting control of the lifting apparatus via the operating valve with a first control valve, the first control valve being controlled by an operating element independently of the operating valve, controlling the operating valve with a second control valve between the operating element and the operating valve; and controlling the control element with the operating element to control the operating valve.

24. The method as set forth in claim 23, comprising shifting the operating valve between the neutral position and the lowering position by controlling the second control valve with the operating element.

* * * * *